US007128465B2

(12) United States Patent
Neumann et al.

(10) Patent No.: US 7,128,465 B2
(45) Date of Patent: Oct. 31, 2006

(54) CLOCK SHAPED LIKE A MUSICAL INSTRUMENT

(75) Inventors: Paul T. Neumann, Louisville, KY (US); James W. Woodhouse, West Linn, OR (US)

(73) Assignee: Daren Webster, Hemet, CA (US)

( * ) Notice: Subject to any disclaimer, the term of this patent is extended or adjusted under 35 U.S.C. 154(b) by 86 days.

(21) Appl. No.: 10/858,138

(22) Filed: Jun. 1, 2004

(65) Prior Publication Data

US 2005/0265131 A1 Dec. 1, 2005

(51) Int. Cl.
*G04B 17/02* (2006.01)
*G04B 37/00* (2006.01)

(52) U.S. Cl. ..... 368/179; 368/276

(58) Field of Classification Search ..... 368/10, 368/76, 80, 160, 165, 1, 179; D10/6
See application file for complete search history.

(56) References Cited

U.S. PATENT DOCUMENTS

| | | | | |
|---|---|---|---|---|
| 3,802,181 | A | 4/1974 | Marquis | |
| 4,241,437 | A | 12/1980 | Ashida | |
| D266,907 | S | 11/1982 | Salen | |
| 5,007,036 | A * | 4/1991 | Kelly, Jr. | 368/134 |
| D371,971 | S | 7/1996 | Wong | |
| D371,972 | S | 7/1996 | Wong | |
| D371,973 | S | 7/1996 | Wong | |
| D375,901 | S | 11/1996 | Wong | |
| 5,926,443 | A * | 7/1999 | Kitaura | 368/165 |
| 6,278,664 | B1 * | 8/2001 | Huffman et al. | 368/223 |

FOREIGN PATENT DOCUMENTS

DE 3029407 A * 3/1982

OTHER PUBLICATIONS http://www.kingsrivergifts.com/catalog/product_info.php/products_1d/2160, Apr. 8, 2004.*
http://www.onlinerock.com/mf_store/brands/c/ColoRiffic_Wilson_Brothers-Style_Gu_435621.htm, Oct. 1, 2005.*
http://drumbum.com/411 Drums, 1999-2006.*

* cited by examiner

*Primary Examiner*—Kamand Cuneo
*Assistant Examiner*—Jeanne-Marguerite Goodwin
(74) *Attorney, Agent, or Firm*—Eric Karich

(57) ABSTRACT

A clock is disclosed including a clock body, a clock drive mechanism mounted on the clock body, an hour hand and a minute hand driven by the clock drive mechanism, and a pendulum driven by the clock drive mechanism. The clock body has a front surface, a perimeter, and a back surface that are shaped to resemble a musical instrument. The pendulum resembles a feature of the musical instrument.

3 Claims, 3 Drawing Sheets

CLOCK SHAPED LIKE A MUSICAL INSTRUMENT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to clocks shaped like musical instruments, and more particularly to a clock that is shaped like a musical instrument and having a pendulum that is shaped to resemble a feature of the musical instrument.

2. Description of Related Art

Clocks that are shaped like a musical instrument are known in the art. Examples of such clocks include Salen, U.S. D266,907 (guitar), Wong, U.S. D371,971 (lute), Wong, U.S. D371,972 (guitar), Wong, U.S. D375,901 (guitar), and Wong, U.S. D371,973 (violin).

Also known are electronic clock motors that include a mechanism for actuating a pendulum, even though a pendulum is not required for the actuation of the clock itself. Examples of this include Ashida, U.S. Pat. No. 4,241,437, and Marquis, U.S. Pat. No. 3,802,181.

The above-described references are hereby incorporated by reference in full.

The prior art teaches clocks that are shaped like musical instruments. However, the prior art does not teach clocks that are shaped like musical instruments that also include a pendulum. The inclusion of a pendulum on a guitar shaped clock would not normally be considered desirable because the pendulum would detract from the ascetics of the musical instrument. In the present invention, however, the pendulum is shaped to resemble a feature of the musical instrument, making the inclusion of the pendulum possible without detracting from the ornamental appearance of the clock.

The present invention fulfills these needs and provides further related advantages as described in the following summary.

SUMMARY OF THE INVENTION

The present invention teaches certain benefits in construction and use which give rise to the objectives described below.

The present invention provides a clock that includes a clock body, a clock drive mechanism mounted on the clock body, an hour hand and a minute hand driven by the clock drive mechanism, and a pendulum driven by the clock drive mechanism. The clock body has a front surface, a perimeter, and a back surface that are shaped to resemble a musical instrument. The pendulum resembles a feature of the musical instrument.

A primary objective of the present invention is to provide a clock having advantages not taught by the prior art.

Another objective is to provide a clock that resembles a musical instrument, and includes a pendulum that resembles a feature of the musical instrument.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
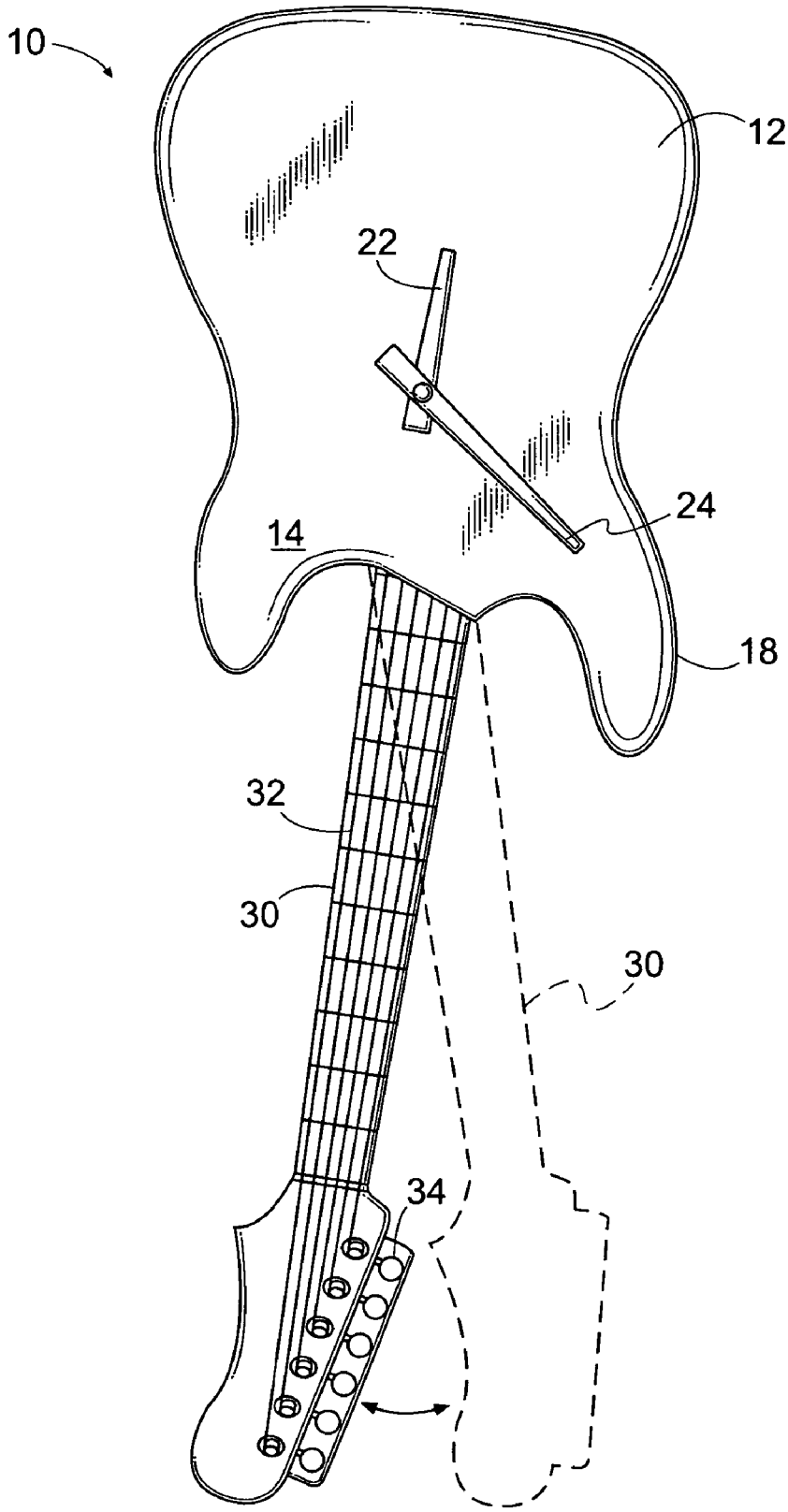
FIG. 1 is a front view of a clock including a clock body having a shape resembling a body of a guitar, and a pendulum extending from the clock body and having a shape resembling a neck and headstock of the guitar.

FIG. 1 is a front view of a clock 10 including a clock body 12 having a shape resembling a musical instrument. In the embodiment of FIG. 1, the clock body 12 has a front surface 14, a back surface (shown as element "16" in FIG. 2) opposite the front surface 14, and a perimeter 18, which together resemble a body of a guitar.

The clock 10 includes a pendulum 30 having a shape resembling a feature of the musical instrument, in this embodiment a neck and headstock of the guitar. The pendulum 30 extends from adjacent the clock body 12 in a downward direction and swings back and forth during operation of the clock 10 as indicated in FIG. 1. In the preferred embodiment, the pendulum 30 of this embodiment includes simulated guitar strings 32 and simulated tuning pins 34. The simulated guitar strings 32 and simulated tuning pins 34 may be printed on the pendulum 30, as shown, or they can be actual physical components that resemble the real thing.

An hour hand 22 and a minute hand 24 are operably mounted adjacent the front surface 14 for displaying the time. The specific mounting and function of these hands 22 and 24 are described in greater detail below.

Figure 2:
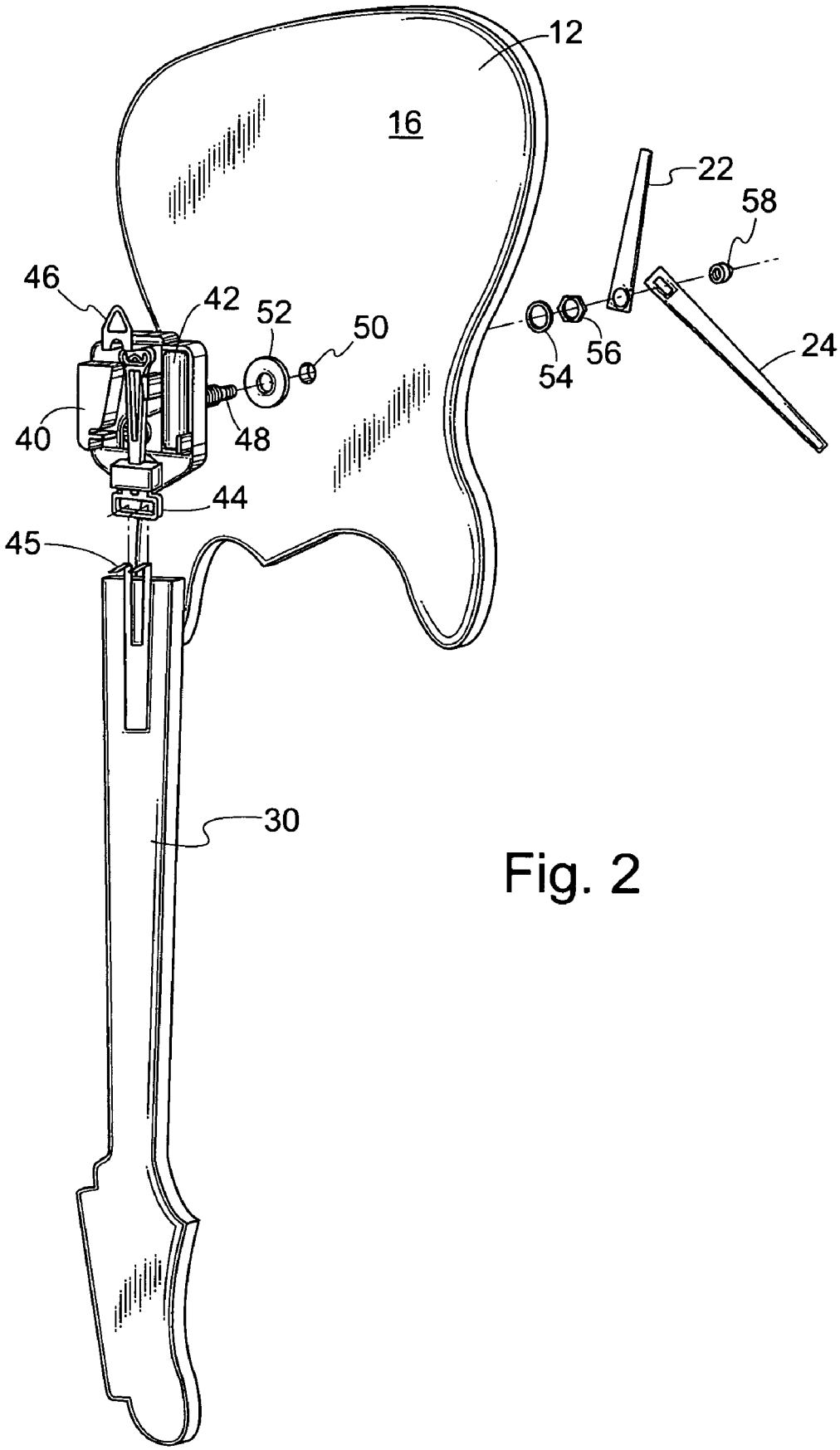
FIG. 2 is an exploded rear view of the clock of FIG. 1.

FIG. 2 is an exploded rear view of the clock 10 of FIG. 1. As shown in FIG. 2, a clock drive mechanism 40 is mounted adjacent the back surface 16. Coaxial shafts 48 of the clock drive mechanism 40 extend through an aperture 50 in the clock body 12. The hour hand 22 is coupled to one of the coaxial shafts 48 and extends outwardly adjacent the front surface 14. Similarly, the minute hand 24 is coupled to another one of the coaxial shafts 48, and the minute hand 24 extends outwardly adjacent the front surface 14. The clock drive mechanism 40 drives the coaxial shafts 48 such that the shafts turn in a clockwise direction at different rates, and the hour hand 22 and the minute hand 24 indicate the current time. The clock drive mechanism 40 also drives the pendulum 30 such that the pendulum 30 swings back and forth.

In the embodiment of FIGS. 1 and 2, the clock drive mechanism 40 is a quartz clock movement and includes, in addition to the coaxial shafts 48, a battery 42 for providing electrical power, a clock hanger 46 for hanging the clock 10 (e.g., on a wall), and a pendulum hanger 44 for connecting to the pendulum 30.

As shown in FIG. 2 the pendulum 30 includes a bracket 45 at an upper end of the guitar neck opposite the headstock. The pendulum hanger 44 of the clock drive mechanism 40 has a slot dimensioned to receive a bent forked end of the bracket 45. The clock drive mechanism 40 drives the pendulum hanger 44 such that the pendulum 30, connected to the pendulum hanger 44 via the bracket 45, swings back and forth.

In assembly, a resilient washer 52 (e.g., a rubber washer) is installed over the coaxial shafts 48 of the clock drive mechanism 40, and the coaxial shafts 48 are inserted into and through the hole 50. A washer 54 (e.g., a brass washer) is installed over the coaxial shafts 48, and a mounting nut 56 is threaded onto a threaded stem surrounding the coaxial shafts 48. The end of the hour hand 22 is installed on one of the coaxial shafts 48. The end of the minute hand 24 is installed on the other one of the coaxial shafts 48, and a nut 58 is threaded onto a threaded end of the other one of the coaxial shafts 48.

In the embodiment of FIGS. 1 and 2 the clock drive mechanism 40 is advantageously a quartz movement that is electronically regulated, and the pendulum 30 does not provide a mechanical regulating function. In other embodiments, however, the clock drive mechanism 40 may be a mechanical movement, and the pendulum 30 may provide a mechanical regulating function.

Figure 3:
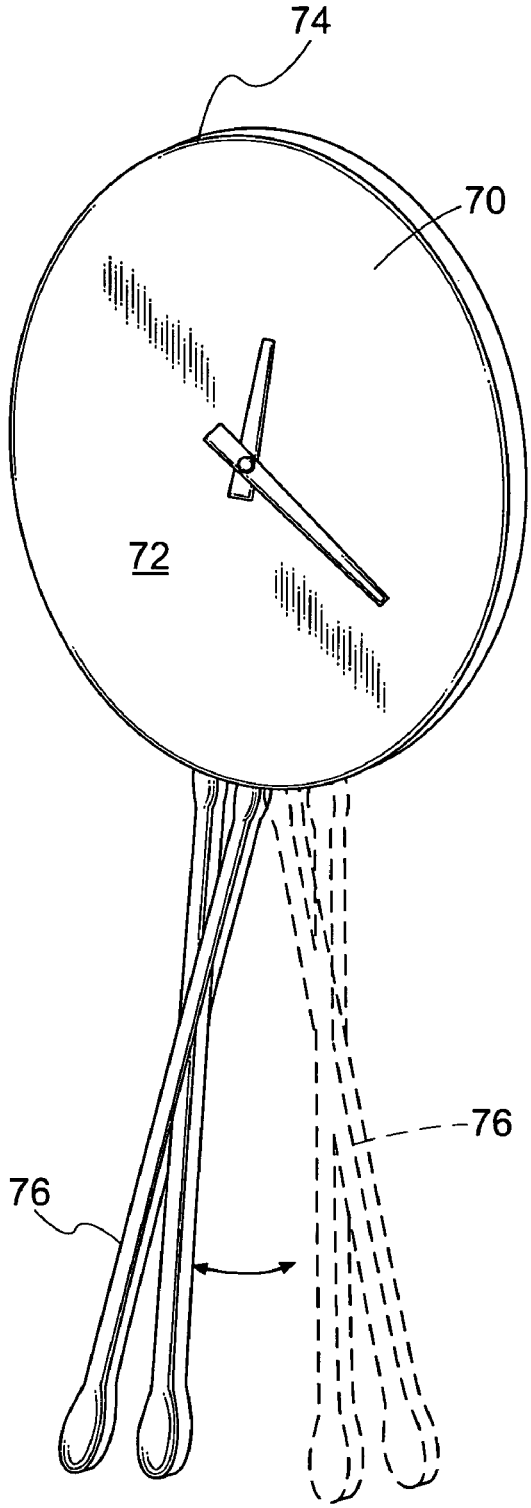
FIG. 3 is a perspective view of an alternative embodiment of the clock, wherein the clock body resembles a drum, and wherein the pendulum resembles a pair of drum sticks.

FIG. 3 is a perspective view of an alternative embodiment of the clock wherein a clock body 70 includes a front surface 72 and a perimeter 74 that are shaped to resembling a drum. In this embodiment, a pendulum 76 extending from the body 70 has a shape resembling a pair of drum sticks.

The present invention can be adapted so that the clock resembles any musical instrument. While we have described two embodiments illustrate two different musical instruments, a guitar and a drum, those skilled in the art will appreciate that the teachings of the invention can be applied to any musical instrument, and such alternatives should be considered within the scope of the present invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A clock comprising:

a clock body having a front surface, a perimeter, and a back surface, the clock body being shaped to resemble a musical instrument;

a clock drive mechanism mounted on the clock body;

an hour hand and a minute hand operably mounted adjacent the front surface of the clock body, the hour hand and the minute hand being operably driven by the clock drive mechanism; and a pendulum driven by the clock drive mechanism, the pendulum being adapted to resemble a feature of the musical instrument, wherein the clock body resembles a body of a guitar, and wherein the pendulum resembles a neck and headstock of the guitar.

2. The clock of claim 1 wherein the pendulum includes simulated guitar strings and simulated tuning pins.

3. A clock comprising:

a clock body having a front surface, a perimeter, and a back surface, the clock body being shaped to resemble a musical instrument;

a clock drive mechanism mounted on the clock body;

an hour hand and a minute hand operably mounted adjacent the front surface of the clock body, the hour hand and the minute hand being operably driven by the clock drive mechanism; and a pendulum driven by the clock drive mechanism, the pendulum being adapted to resemble a feature of the musical instrument, wherein the clock body resembles a drum, and wherein the pendulum resembles a pair of drum sticks.

* * * * *